United States Patent [19]

Ehemann

[11] 4,411,051

[45] Oct. 25, 1983

[54] PROCESS FOR HEAT TREATING TEXTILE MATERIAL ITEMS

[75] Inventor: Gero Ehemann, Gross-Ippener, Fed. Rep. of Germany

[73] Assignee: Kurt Ehemann Spezialmaschinenfabrik KG, Fed. Rep. of Germany

[21] Appl. No.: 257,544

[22] Filed: Apr. 27, 1981

[30] Foreign Application Priority Data

Apr. 28, 1980 [DE] Fed. Rep. of Germany ..... 3016365

[51] Int. Cl.[3] ..... D06C 23/04; F25B 29/00

[52] U.S. Cl. ..... 26/18.5; 26/1; 28/167; 165/30

[58] Field of Search ..... 165/30; 26/1, 18.5; 28/167

[56] References Cited

U.S. PATENT DOCUMENTS 1,967,130 7/1934 Nuernberg ..... 26/1

2,944,317 7/1960 Cohn et al. ..... 26/18.5

*Primary Examiner*—Albert W. Davis, Jr.

*Assistant Examiner*—S. Gayle Dotson

*Attorney, Agent, or Firm*—Kalish & Gilster

[57] ABSTRACT

The process of protecting heat sensitive regions of textile material webs from damage during thermo-treatment by preliminarily subjecting such regions to a suitable cooling or chilling agent selectively applied to such regions in order to lower the temperature thereof sufficiently so that the ultimate elevation caused by the normal subsequent thermo-treatment will not be adequate to bring about damage to the heat sensitive regions.

14 Claims, 1 Drawing Figure

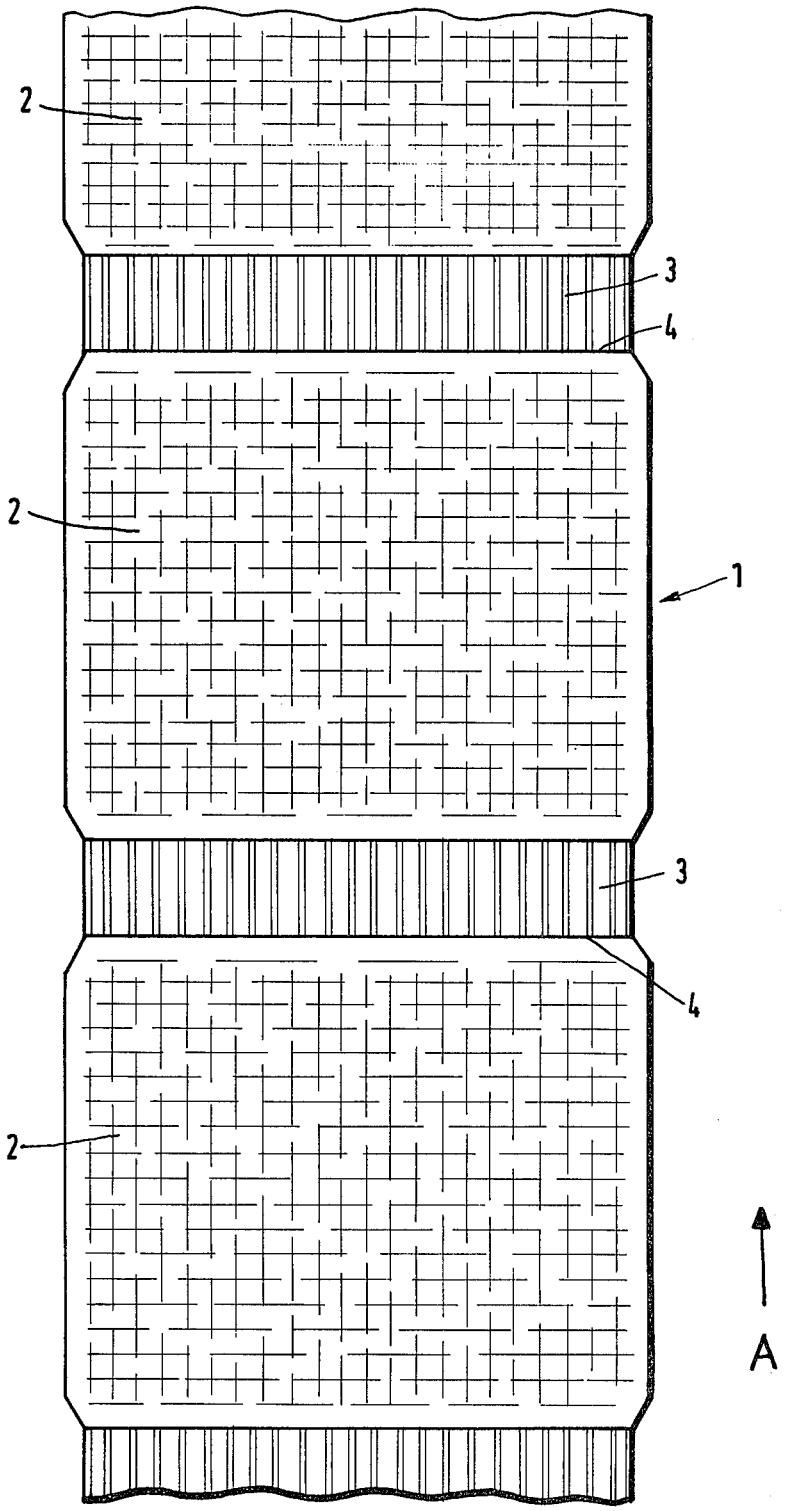
2
3
4
2
1
3
4
2
A

PROCESS FOR HEAT TREATING TEXTILE MATERIAL ITEMS

BACKGROUND AND SUMMARY OF THE INVENTION

This invention relates, in general, to textile fabric, and more particularly, to a process for heat treating textile material webs, especially knit fabric, on finishing machines.

In the treatment of textile material webs, as the same are passed through finishing machines, such webs are heated, as under the influence of steam, hot air, or other suitable sources of heat. In those cases in which, for example, knit fabric provided with ribbed edges is so treated, the elasticity and springiness of such edges are damaged under the influence of heat and this is particularly so if the knit fabric or the ribbed edges thereof consist of fibers having a low melting point, as, for example, being formed of acrylic resins or acrylic blends.

It is known that one may utilize mechanical protective means in the form of covering materials or plates disposed upon tensioning frames or other conveyor belt systems in order to avoid the undesired change in the properties of the fibers in the region of the ribbed edges. However, mechanical protective means of this type require comparatively extensive effort and have proved markedly expensive thereby complicating the design of the machine as well as the operating thereof.

Therefore, it is an object of the present invention to effect protection of specific regions of textile material webs during the treatment thereof on finishing machines, from the influence of steam, hot air, or other sources of heat in a relatively inexpensive manner, whereby the use of mechanical covering elements for protective purposes may be eliminated.

It is a further object of the present invention to provide a method for protecting specific regions of textile material webs from being damaged under the influence of heat during transmission in finishing machines by suitably reducing the temperature of such regions so that the subsequent elevation by the heat treatment will not reach the degree at which damage is caused.

It is a further object of the present invention to provide a method of the character stated which may be easily effected and which does not require the utilization of costly agents.

Essentially, the method of this invention is advantageously accomplished by cooling or chilling the particular regions of the web to be protected to such a low temperature that during the subsequent heat transmission as in a finishing machine will only effect a reheating to a level that is not damaging or detrimental to the erstwhile cooled or chilled web portion.

BRIEF DESCRIPTION OF THE DRAWING

The drawing is a top plan view of body portions of a web of knit fabric as being transported into the heat treatment zone of a finishing machine.

DESCRIPTION OF THE INVENTION

The process of the present invention which comprises basically the protection of preselected portions of knit fabric from accidental damage during heat treatment as, for example, effected in finishing machines, may be assisted in comprehension by reference to the drawing wherein 1 indicates a web of knit fabric having body portions 2 with intervening sections or ribbed edges 3 demarcated by seams 4. Thus, web 1 consists of a plurality of knit fabric body portions each provided with a ribbed edge being attached one to another for facilitating treatment. Web 1 is thus conveyable by a transporting belt (not shown) as in the direction of the arrow A into the treatment zone of a conventional finishing machine (not shown) and therein treated with steam and/or heated or hot air which latter is at a temperature within ranges well known for thermotreatment. It is recognized that regions of textile material webs, of the type generally shown, are more temperature-sensitive than others, such as, for example, ribbed edges 3 as opposed to body portions 2. Thus, such regions may be damaged during the customary heat treatment to such an extent that resultant adverse changes in characteristics are effected in the fibers of such regions. In order to prevent the heat treatment from adversely affecting the sensitive portions of the web, as by reducing the properties of extensibility and elasticity, as in the present instance ribbed edges 3, which may, for example, by an acrylic fiber, the sections of ribbed edges 3 are cooled before introduction to heat treatment. Thus, the cooling is of such order that the temperature sensitive portions are in effect frozen so that during the subsequent heat treatment the elevation of such chilled or cooled sections will not attain a temperature level which is damaging thereto. This cooling or, in effect, freezing step, can be brought about by spraying liquid nitrogen thereupon which will lower the temperature thereof to the boiling point of nitrogen, that is, −195° C. Such chilling or cooling may also be brought about by other suitable agents of gaseous and/or liquid character, the only criterion being that they being about a temperature decrease of such extent that the succeeding heat treatment will not raise the temperature of the cooled or chilled section to a point which is damaging. Thus, for example, ammonia may be applied to section 3 in question which is chilled to −33° C., being the boiling point of ammonia; with another example of such agent being carbon dioxide which brings about a chilling to the boiling point thereof −78° C. Thus, the foregoing are merely examples of any number of suitable agents which may lower the temperature sufficiently to assure against any undesired affects resulting from thermo-treatment.

The application of the selected chilling or cooling agent is a matter of convenient choice. Thus, conventional spraying means embodying compatible nozzles may be used to apply the cooling agent to only the specific zone in question or selective immersion of such regions within a bath of the liquid chilling agent may be readily accomplished. Thus, the application of the chilling agent may be brought about through the use of ordinary, accepted expedients.

By restricting the application of the cooling or chilling agent to the specific areas, there is no abrupt temperature drop between the knit fabric regions adjacent the ribbed edges and the ribbed edges themselves but, there is rather a gradual temperature transition, the extent of which is dependent upon the accuracy of metering the chilling agent, such as liquid nitrogen, which can be effectively governed by the aid of well known means.

In actual practice, the web 1 is normally at room temperature, about 18° C., prior to the selective cooling treatment. After the cooling of the zones or regions to be protected has been brought about, the web is subjected to the usual heat treatment as within a finishing machine and brought up to a temperature within the range of usually approximately 90° to 150° C., depending upon the type of web material and the type of finishing operation which may be steaming, shrinking, heat-setting, or decatizing, all of which are well known and widely practiced. It is to be understood that the chilling treatment step may be necessitated several times within the course of the entire treatment process should such be determined necessary for adequate protection of the heat sensitive knit fabric regions.

Merely exemplary of a still further means for chilling selected portions of a continuous knit fabric web is an arrangement providing for the transport of the textile web by a carrier web over a bath of the liquid chilling agent and with only the heat sensitive regions being immersed within such bath by operation of a roller rotatably carried upon a pivotally mounted arm, with there being means for rocking said arm to cause the roller to force the selected zone of the web downwardly and into the bath for a predetermined period of time. This unique arrangement will permit of the use of timing means so that the interval of immersion may be controlled and thus be consonant with the predetermined rate of travel of the carrier web with the textile material web thereon.

In view of the foregoint it is indeed apparent that the present invention provides a very efficient, highly effective and relatively easily performed process for reliably protecting heat sensitive zones of textile fabrics against deleterious results from heat treatment. The selected cooling treatment as developed herein thus obviates the heretofore accepted resort to mechanical covering means for protecting such zones which have proved quite expensive in operation, as well as having attendant imperfect results.

I claim:

1. A process for heat treating textile material webs, in particular knit fabric, characterized in that the textile material web is, in the regions in which it is to be protected during heat treatment from too intense an influence of steam, hot air or heat, cooled under the influence of a chilling or cooling agent to a temperature selected to be so low that the material web during the subsequent heat treatment is only still reheated to a temperature that is not detrimental to the textile material web.

2. A process according to claim 1, characterized in that the said regions of the textile material web are frozen by means of cooling.

3. A process according to claim 1 or 2, characterized in that liquid nitrogen is used for cooling the said regions of the textile material web.

4. A process according to claim 1 or 2, characterized in that carbon dioxide is used for cooling the said regions of the textile material web.

5. A process according to claim 1 or 2, characterized in that ammonia is used for cooling the said regions of the textile material web.

6. A process according to claim 1, characterized in that the cooling or chilling agent may be applied in a liquid state onto the region of the material web to be treated.

7. A process according to claim 2, characterized in that the regions of the textile material web to be protected are ribbed edges of the knit fabric.

8. A process according to claim 2, characterized in that the textile material web is protected by means of freezing from being heated too much in the regions consisting of fibers having a low melting point, such as acryl or acrylic blends.

9. A process according to claim 1, characterized in that the textile material web is protected by means of freezing from being heated too much in order to retain the elasticity an springiness of the textile fibers.

10. A process for heat treating knit fabric for finishing same which fabric contains at least a single discrete portion damagably sensitive to the finishing heat temperature comprising initially, selectively subjecting such discrete portion to cooling to lower the temperature thereof to such a degree that subsequent subjection of such discrete portion to the heat treatment temperature of the knit fabric containing same will prevent such discrete portion from attaining the fabric finishing temperature, and then subjecting the said fabric with the contained discrete portion to heat adequate for finishing the fabric.

11. A process according to claim 10 wherein the cooling lowers the temperature of the discrete portion to a frozen state.

12. A process according to claims 10 or 11 wherein the knit fabric is in a continuous web form and contains a plurality of such discrete portions spacedly throughout the length of said fabric.

13. A process according to claims 10 or 11 wherein the knit fabric is in continuous web form and contains a plurality of such discrete portions spacedly throughout the length of said fabric which portions are ribbed edges.

14. A process according to claims 10 or 11 wherein the cooling is effected by treating such discrete portion with a liquid coolant.

* * * * *